US006478117B2

(12) United States Patent
Swaybill

(10) Patent No.: US 6,478,117 B2
(45) Date of Patent: Nov. 12, 2002

(54) ELEVATOR SYSTEM HAVING GOVERNOR POSITIONED UNDER CONTROLLER IN HOISTWAY AT TOP FLOOR LEVEL

(75) Inventor: Bruce P. Swaybill, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/183,135

(22) Filed: Oct. 30, 1998

(65) Prior Publication Data

US 2001/0045329 A1 Nov. 29, 2001

(51) Int. Cl.[7] ..... B66B 5/02; B66B 1/24

(52) U.S. Cl. ..... 187/305; 187/373; 187/286; 187/287

(58) Field of Search ..... 187/373, 281, 187/287, 414, 286, 305, 350, 391

(56) References Cited

U.S. PATENT DOCUMENTS

| | | | | | |
|---|---|---|---|---|---|
| 1,071,309 | A | | 8/1913 | Goggin | |
| 3,101,130 | A | | 8/1963 | Bianca | |
| 4,083,432 | A | * | 4/1978 | Lusti | 187/373 |
| 4,565,264 | A | * | 1/1986 | Kunii | 187/373 |
| 4,662,481 | A | * | 5/1987 | Morris et al. | 187/373 |
| 4,949,815 | A | | 8/1990 | Pavoz | |
| 5,052,523 | A | * | 10/1991 | Ericson | 187/373 X |
| 5,429,211 | A | | 7/1995 | Aulanko et al. | 187/254 |
| 5,435,417 | A | | 7/1995 | Hakala | 187/404 |
| 5,469,937 | A | | 11/1995 | Hakala et al. | 187/266 |
| 5,490,578 | A | | 2/1996 | Aulanko et al. | 187/254 |
| 5,495,919 | A | * | 3/1996 | Ericson et al. | 187/373 |
| 5,797,472 | A | * | 8/1998 | Kamani et al. | 187/373 |
| 5,971,109 | A | * | 10/1999 | Aulanko et al. | 187/350 |
| 6,223,660 | B1 | * | 5/2001 | Namba et al. | 187/391 X |
| 6,230,845 | B1 | * | 5/2001 | Yamakawa et al. | 187/391 |
| 6,230,846 | B1 | * | 5/2001 | Namba et al. | 187/414 |

FOREIGN PATENT DOCUMENTS

| | | | | |
|---|---|---|---|---|
| AU | 1 032 496 | | 6/1958 | |
| DE | 296 15 921 | U1 | 4/1997 | |
| EP | 0 606 875 | A1 | 1/1994 | |
| EP | 0 779 233 | A2 | 6/1994 | |
| EP | 0 784 030 | A2 | 6/1994 | |
| EP | 613851 | A1 * | 9/1994 | |
| EP | 0 688 735 | A2 | 6/1995 | |
| EP | 0 710 618 | A2 | 10/1995 | |
| EP | 0 749 930 | A2 | 6/1996 | |
| EP | 0 749 931 | A2 | 6/1996 | |
| FR | 2 640 604 | | 12/1988 | |
| GB | 2 138 397 | B | 11/1985 | |
| GB | 2 2-1 657 | B | 8/1990 | |
| JP | 53-131464 | A * | 11/1978 | 187/305 |
| JP | 1-242386 | | 9/1989 | |
| WO | WO 96/09978 | | 4/1996 | |
| WO | WO 98/40305 | A1 * | 9/1998 | |

OTHER PUBLICATIONS

"Elevator Mechanical Design, Principles and Concepts", by Lubomir Janovsky, Ellis Horwood Limited (1987).

* cited by examiner

*Primary Examiner*—Christopher P. Ellis
*Assistant Examiner*—Thuy V. Tran

(57) ABSTRACT

A machineroomless elevator system (10) has a controller (32)and a governor (38) positioned in the hoistway (12) at the top floor level (28), such that the controller (32) and the governor (38) are both positioned between the front wall (14) of the hoistway (12) and an elevator car guide rail (34) positioned on a sidewall (18) of the hoistway (12).

8 Claims, 3 Drawing Sheets

ELEVATOR SYSTEM HAVING GOVERNOR POSITIONED UNDER CONTROLLER IN HOISTWAY AT TOP FLOOR LEVEL

TECHNICAL FIELD

This invention relates to elevator systems and, more particularly, to an elevator system in which the governor is located underneath the controller, and both are positioned in the hoistway at the top floor level.

BACKGROUND OF THE INVENTION

Known elevator systems typically confine all elevator components to the hoistway or the machine room. The hoistway is an elongated, vertical shaft having a rectangular base in which the elevator car translates. The hoistway houses, among other things, the car guide rails which are usually a pair of generally parallel rails, fixed to opposite walls near the center of each wall, and running the approximate length of the hoistway. A counterweight having a pair of guide rails is positioned adjacent to a third wall. The hoistway houses additional components including terminal landing switches, ropes and sheave arrangements, and buffers for the counterweight and the car.

It is essential that the elevator components are located and oriented with precision prior to and during operation. The interior walls of the hoistway must be properly dimensioned and aligned, and the physical interface between the hoistway walls and the elevator components must be capable of withstanding varying load during use. It is particularly essential that the guide rails on which the car rides are properly positioned and solidly maintained. For quality of ride and safety, the guide rails need to be precisely plumb, square and spaced to avoid car sway, vibration and knocking. Guide rails are typically steel, T-shaped sections in sixteen foot lengths. The position of guide rails within the hoistway affects the position of the hoisting machine, governor and overhead (machine room) equipment. The machine room is typically located directly above the hoistway. The machine room houses the hoist machine and governor, the car controller, a positioning device, a motor generator set, and a service disconnect switch.

In certain elevator systems that do not have a machine room, various components are located in the hoistway. It is difficult to locate the governor in a position that is safe and space efficient, since the governor and safety roping arrangement must be free from interference or potential damage.

OBJECTS AND SUMMARY OF THE PRESENT INVENTION

It is an object of the present invention to provide an elevator system in which a conventional machine room is eliminated and the controller and governor are located in positions in which interference with the governor and safety system's roping is avoided.

This object and inherent advantages of the present invention are described herein.

The present invention is directed to an elevator system generally comprising a hoistway, and elevator car, a counterweight, respective guide rails for guiding the vertical movement of each of the elevator car and the counterweight, a machine and associated drive system, a controller and a governor. The machine and controller are located in the hoistway. Instead of locating the governor above the car, as in conventional systems, the governor is located below the controller, and above the elevator car safety linkage. The controller is positioned at the top floor level.

The controller may be positioned between elevator car and a side wall of the hoistway, and between the guide rails and the front wall of the hoistway. To avoid interference with the governor and safety system roping arrangement, the governor is positioned beneath the controller but at floor level of the top floor.

DESCRIPTION OF THE PREFERRED EMBODIMENTS

Figure 1:
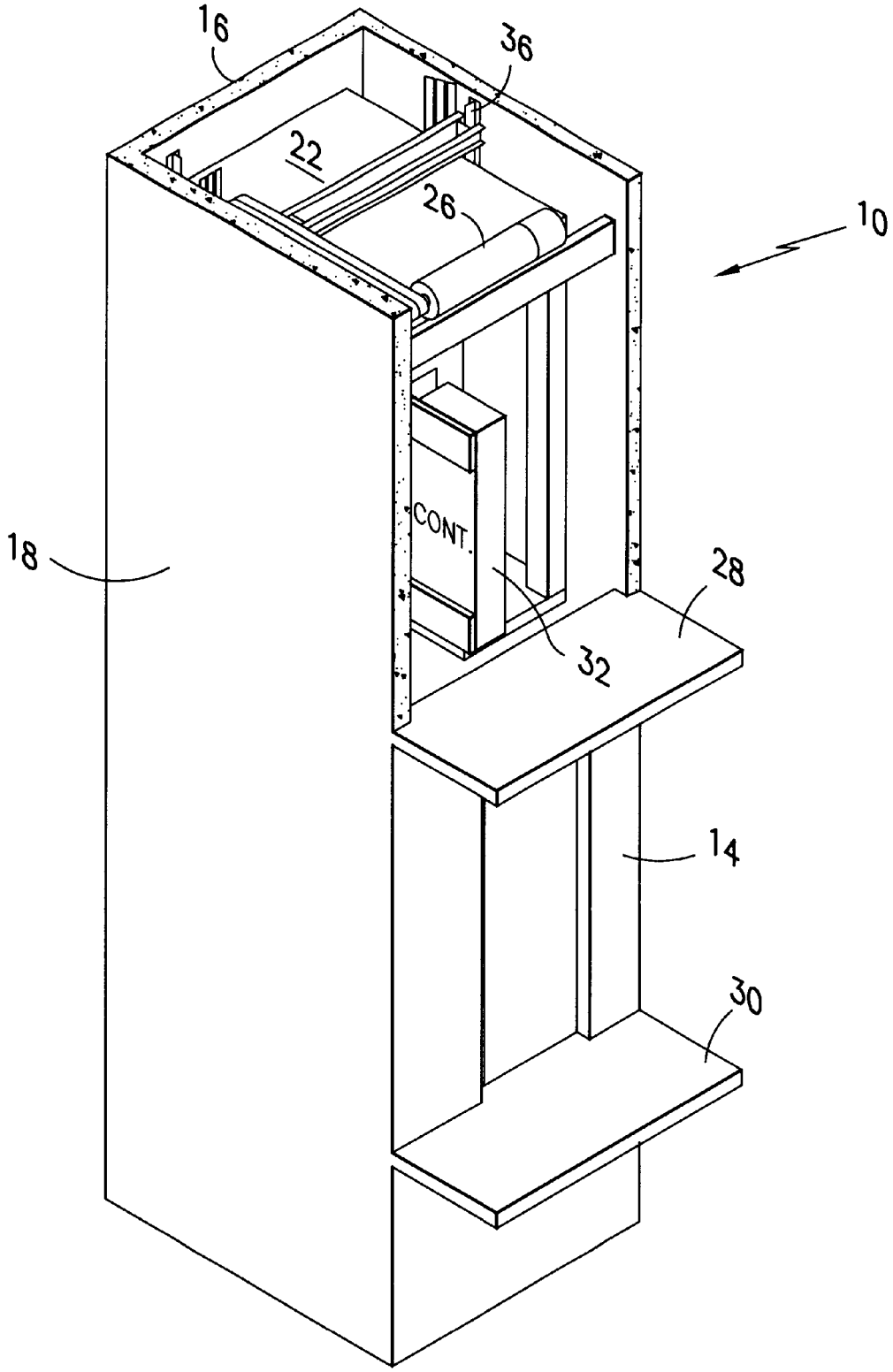
FIG. 1 is a schematic, orthogonal view of a preferred embodiment of an elevator system according to the present invention, wherein a controller is positioned outside of a hoistway.
Figure 2:
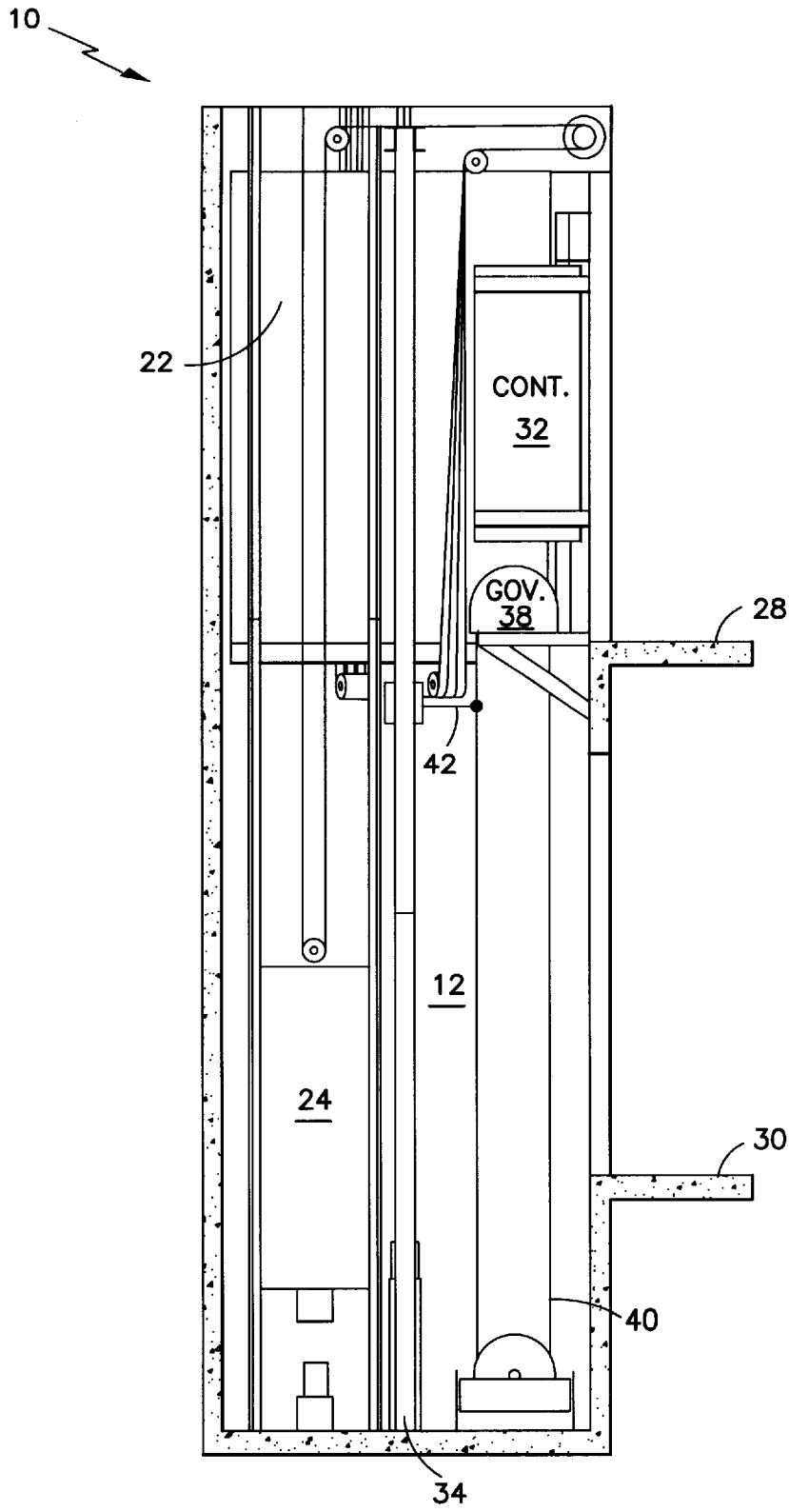
FIG. 2 is a schematic, side view of the elevator system shown in FIG. 1, wherein the controller is positioned inside of the hoistway.
Figure 3:
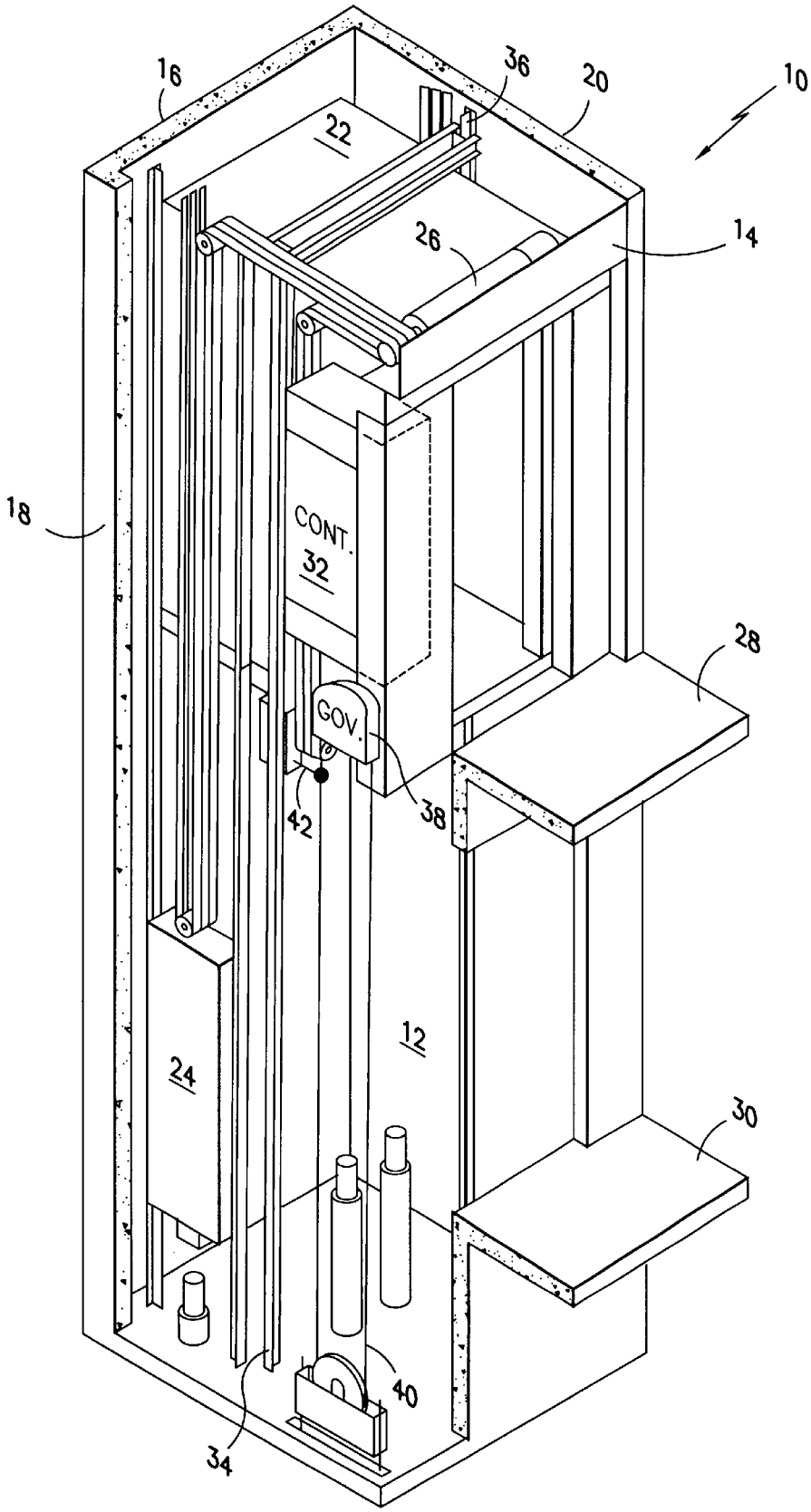
FIG. 3 is a schematic, orthogonal view of the elevator system as shown in FIG. 2.

An elevator system (10) is shown in FIGS. 1–3, including a hoistway (12) having front (14), back (16) and side (18, 20) walls. First (28) and second (30) landings indicate top and lower floors, respectively. An elevator car (22) is suspended in the hoistway (12) by ropes (14) coupled to a counterweight (24) and driven by a machine (26) mounted overhead. A pair of guide rails (34, 36) are provided to guide the vertical movement of the elevator car (22).

The hoistway (12) is sized sufficiently in length and width dimensions so that an area large enough to accommodate the controller (32) within the hoistway (12) is provided. The controller (32) is positioned between the elevator car (22) and hoistway side wall (18), and between an elevator car guide rail (34) of the front wall. The governor (38) is positioned beneath the controller (32) so that the governor safety and roping system (40) are in a position in which interference with other components is prevented. The governor (38) is positioned above the car safety linkage (42) for safe and proper operation.

As shown, the elevator system (10) of the embodiment described above locates the controller (32) and governor (38) within the hoistway (12) in a position in which operation of the governor is maintained without compromising safety.

It is acknowledged that some variation in the design of the specific embodiment may be made without departing from the scope of the presently claimed invention.

What is claimed is:

1. An elevator system comprising a hoistway including a top landing with a floor;

an elevator car suspended within said hoistway and adapted for vertical movement therein; and a governor fixed within the hoistway and approximately at floor level of said top landing floor, said governor connected with a safety system roping that is connected to said elevator car.

2. An elevator system according to claim 1, further comprising at least one side wall and a front wall within said hoistway;

guide track means extending generally vertically along said side wall for guiding said elevator car in a vertical direction; and a controller positioned in said hoistway between said guide track means and said front wall.

3. An elevator system according to claim 2, wherein said controller and said governor are accessible from the top floor of the structure in which said elevator system is housed.

4. An elevator system according to claim 2, wherein said controller and said governor are positioned between said elevator car and said side wall.

5. An elevator system according to claim 2, wherein said guide track means comprise at least one guide rail.

6. An elevator according to claim 5, wherein said guide rail is positioned generally in the center of the side wall.

7. An elevator system according to claim 1, wherein said safety system roping extends vertically below said governor.

8. An elevator system according to claims 1, wherein said elevator car further includes a car safety linkage, and wherein said governor is positioned above the car safety linkage.

* * * * *